US009717386B2

(12) United States Patent
Wall et al.

(10) Patent No.: US 9,717,386 B2
(45) Date of Patent: Aug. 1, 2017

(54) LIQUID EXTRACTION CLEANING DEVICE

(71) Applicant: Rug Doctor, LLC, Plano, TX (US)

(72) Inventors: Timothy Wall, Plano, TX (US); Ann Marie Morrow, Plano, TX (US); Walter Haug, Plano, TX (US); Phuong Le, St. Charles, MO (US); Charles Michael Ostendorf, St. Clair, MO (US); Schubert Pereira, Fenton, MO (US); Ernest Matthew Chavana, Jr., Fenton, MO (US); Vincent Lau, Fenton, MO (US); Jason Edward Hill, St. Louis, MO (US); Jason Tilk, Cleveland, OH (US); Evan Spirk, Cleveland, OH (US); Lindsey Tufts, Cleveland, OH (US); Craig Saunders, Cleveland, OH (US); Paul Stephens, Cleveland, OH (US)

(73) Assignee: RUG DOCTOR, LLC, Plano, TX (US)

( * ) Notice: Subject to any disclaimer, the term of this patent is extended or adjusted under 35 U.S.C. 154(b) by 365 days.

(21) Appl. No.: 14/613,522

(22) Filed: Feb. 4, 2015

(65) Prior Publication Data

US 2015/0245751 A1 Sep. 3, 2015

Related U.S. Application Data

(60) Provisional application No. 61/946,443, filed on Feb. 28, 2014.

(51) Int. Cl.
*A47L 7/00* (2006.01)
*A47L 11/40* (2006.01)
(Continued)

(52) U.S. Cl.
CPC ..... *A47L 11/34* (2013.01); *A47L 11/4002* (2013.01); *A47L 11/4036* (2013.01);
(Continued)

(58) Field of Classification Search
CPC .. A47L 11/34; A47L 11/4002; A47L 11/4036; A47L 11/4075; A47L 11/4083;
(Continued)

(56) References Cited

U.S. PATENT DOCUMENTS 3,203,707 A 8/1965 Arne
4,660,246 A 4/1987 Duncan et al.
(Continued)

*Primary Examiner* — Dung Van Nguyen
(74) *Attorney, Agent, or Firm* — Thompson Coburn LLP

(57) ABSTRACT

A liquid extraction cleaning device comprises a vacuum pump, a liquid pump, a cleaning solution tank, a recovery tank, first and second spray nozzles, a spray selection switch, a vacuum inlet port, an agitator assembly, and a handle. The spray selection switch controls whether liquid is expelled from the second spray nozzle when liquid is expelled from the first spray nozzle. The agitator assembly comprises first and second agitators. The first agitator is configured to rotate. The second agitator is configured to reciprocate. The handle is pivotally connected to the rest of the liquid extraction cleaning device and is lockable in several pivotal orientations. The handle can also be pivoted forward from a rearwardly extending direction to an extent that it extends forward horizontally.

7 Claims, 12 Drawing Sheets

(51) Int. Cl.
*A47L 11/30* (2006.01)
*A47L 11/34* (2006.01)

(52) U.S. Cl.
CPC ..... *A47L 11/4075* (2013.01); *A47L 11/4083* (2013.01); *A47L 11/4088* (2013.01)

(58) Field of Classification Search
CPC ... A47L 11/4088; A47L 11/4044; A47L 11/30
See application file for complete search history.

(56) References Cited

U.S. PATENT DOCUMENTS 5,483,726 A 1/1996 Blase et al.
5,715,566 A 2/1998 Weaver et al.
5,797,163 A 8/1998 Whitaker et al.
5,983,442 A 11/1999 Louis et al.
6,009,593 A * 1/2000 Crouser ..... A46B 13/00 15/320
6,041,472 A 3/2000 Kasen et al.
6,081,962 A 7/2000 Kasen et al.
6,131,237 A 10/2000 Kasper et al.
6,158,081 A * 12/2000 Kasen ..... A47L 5/28 15/320
6,167,587 B1 1/2001 Kasper et al.
6,247,202 B1 * 6/2001 Lesco ..... A47L 11/03 15/320
6,286,180 B1 9/2001 Kasper et al.
6,446,302 B1 * 9/2002 Kasper ..... A47L 11/30 15/319
6,467,122 B2 * 10/2002 Lenkiewicz ..... A47L 11/34 15/320
6,681,442 B2 * 1/2004 Coates ..... A47L 11/03 15/320
6,842,942 B2 * 1/2005 Morgan ..... A47L 5/28 15/322
7,146,679 B2 12/2006 Coates et al.
7,146,682 B2 12/2006 Damman et al.
7,159,271 B2 1/2007 Sepke et al.
7,225,503 B1 6/2007 Lenkiewicz et al.
7,350,262 B2 4/2008 Scheifele
7,904,990 B1 * 3/2011 Miner ..... A47L 11/34 15/320
7,979,951 B2 7/2011 Lenkiewicz et al.
8,020,251 B2 9/2011 Luebbering et al.
2002/0013975 A1 2/2002 Fulghum
2002/0014259 A1 2/2002 Hahnl
2003/0070249 A1 4/2003 Lehman et al.
2003/0159232 A1 8/2003 Hekman et al.
2005/0236012 A1 10/2005 Josefsson et al.
2009/0165822 A1 7/2009 Kintz et al.
2010/0205769 A1 8/2010 Mitchell et al.

* cited by examiner

LIQUID EXTRACTION CLEANING DEVICE

CROSS-REFERENCE TO RELATED APPLICATIONS

This patent application claims the benefit of provisional patent application Ser. No. 61/946,443, which was filed on Feb. 28, 2014.

STATEMENT REGARDING FEDERALLY SPONSORED RESEARCH OR DEVELOPMENT

Not applicable.

APPENDIX

Not applicable.

BACKGROUND OF THE INVENTION

Field of the Invention

The present invention pertains to liquid extraction cleaning devices of the type that spray cleaning liquid onto surfaces and thereafter suck the liquid back up to clean such surfaces. More specifically, the present invention pertains to liquid extraction cleaning devices that are used to clean carpet or upholstery and that store the cleaning solution and recovered liquid onboard.

General Background

Some carpet and upholstery extraction cleaners are known in the industry as floor cleaners and some are known as spot cleaners.

A typical floor cleaner comprises a wheeled main unit that rests on the floor and comprises one or more liquid spray nozzles, one or more agitators, and one or more vacuum intake nozzles beneath the main unit. As the main unit of such a floor cleaner is dragged over carpet, liquid spray is discharged from the main unit. The agitator of the main unit is then used to work the liquid into the carpet. Following the agitation, the vacuum intake nozzles of the main unit extract as much of the soiled liquid from the carpet as possible. It is common for floor cleaners to be configured to perform all of these actions simultaneously, albeit on different portions of the carpet. Thus, as the main unit is dragged or self-propelled over carpet, the spraying, agitating, and vacuuming occurs sequentially on any given portion of the carpet.

Spot cleaners tend to be smaller than floor cleaners and are typically used to pick up spills, remove localized stains, or clean furniture upholstery. Some spot cleaners are merely handheld devices that comprise the same general features of the larger floor cleaners, but without the wheels. Other spot cleaners comprise a hand tool that is attached to a main unit via a flexible hose. With such hand tool spot cleaners, the hand tool performs the spraying and the vacuuming and may or may not perform agitation. The vacuum motor and most other necessary components of such hand tool spot cleaners are contained in the main unit. Many floor cleaners are provided with an accessory hand tool and hose that allow the floor cleaners to also serve as spot cleaners.

SUMMARY OF THE INVENTION

The present invention is directed primarily to floor cleaner liquid extraction devices.

In one aspect of the invention, a liquid extraction cleaning device comprises a vacuum pump, a liquid pump, a cleaning solution tank, a recovery tank, a spray nozzle, a vacuum inlet port, and an agitator assembly. The cleaning solution tank is configured and adapted to store a cleaning liquid and is operatively connected to the liquid pump in a manner such that the liquid pump can draw cleaning liquid from the cleaning solution tank. The recovery tank is configured and adapted to store soiled cleaning liquid extracted from a floor and is operatively connected to the vacuum pump in a manner such that the vacuum pump can draw air from the recovery tank. The spray nozzle is operatively connected to the liquid pump in a manner such that the liquid pump is capable of forcing cleaning liquid out of the spray nozzle. The vacuum inlet port is operatively connected to the recovery tank and the vacuum pump in a manner such that the vacuum pump is capable of drawing fluid through the vacuum inlet port and into the recovery tank. The agitator assembly comprises first and second agitators and an electric motor. The first agitator is operatively connected to the electric motor in a manner such that operation of the electric motor causes the first agitator to rotate. The second agitator is operatively connected to the electric motor in a manner such that operation of the electric motor causes the second agitator to reciprocate.

In another aspect of the invention, a liquid extraction cleaning device comprises a vacuum pump, a liquid pump, a cleaning solution tank, a recovery tank, a vacuum inlet port, an agitator assembly, first and second spray nozzles, and a liquid spray selection switch. The cleaning solution tank is configured and adapted to store a cleaning liquid and is operatively connected to the liquid pump in a manner such that the liquid pump can draw cleaning liquid from the cleaning solution tank. The recovery tank is configured and adapted to store soiled cleaning liquid extracted from a floor and is operatively connected to the vacuum pump in a manner such that the vacuum pump can draw air from the recovery tank. The vacuum inlet port is operatively connected to the recovery tank and the vacuum pump in a manner such that the vacuum pump is capable of drawing fluid through the vacuum inlet port and into the recovery tank. The agitator assembly comprises an agitator that is configured and adapted to move relative to the inlet port. Each of the first and second spray nozzles is operatively connected to the liquid pump in a manner such that the liquid pump is capable of forcing cleaning liquid from the cleaning solution tank out of the spray nozzle. The liquid spray selection switch is adapted and configured to selectively prevent cleaning liquid pumped by the liquid pump from being forced out of the second spray nozzle while permitting cleaning liquid pumped by the liquid pump to be forced out of the first spray nozzle, the liquid spray selection switch is also adapted and configured to selectively permit cleaning liquid pumped by the liquid pump to be forced out of the first and second spray nozzles simultaneously.

In yet another aspect of the invention, a liquid extraction cleaning device comprises a main unit, a cleaning solution tank, a recovery tank, a vacuum inlet port, and an adjustable handle. The main unit comprises a vacuum pump, a liquid pump, an agitator assembly, and a spray nozzle. The agitator assembly comprises an agitator. The spray nozzle is operatively connected to the liquid pump in a manner such that the liquid pump is capable of forcing cleaning liquid out of the spray nozzle. The cleaning solution tank is configured and adapted to store a cleaning liquid and is operatively connected to the liquid pump in a manner such that the liquid pump can draw cleaning liquid from the cleaning solution tank. The recovery tank is configured and adapted to store soiled cleaning liquid extracted from a floor and is operatively connected to the vacuum pump in a manner such that the vacuum pump can draw air from the recovery tank. The vacuum inlet port is operatively connected to the recovery tank and the vacuum pump in a manner such that the vacuum pump is capable of drawing fluid through the vacuum inlet port and into the recovery tank. The agitator is configured and adapted to move relative to the inlet port. The handle is pivotally connected to the main unit and comprises a locking mechanism and a release member. The locking mechanism is configured and adapted to lock the handle in each of a plurality of pivotal orientations relative to the main unit. The release member is configured and adapted to release the locking mechanism in a manner allowing the handle to pivot relative to the main unit.

Further features and advantages of the present invention, as well as the operation of the invention, are described in detail below with reference to the accompanying drawings.

Figure 1:
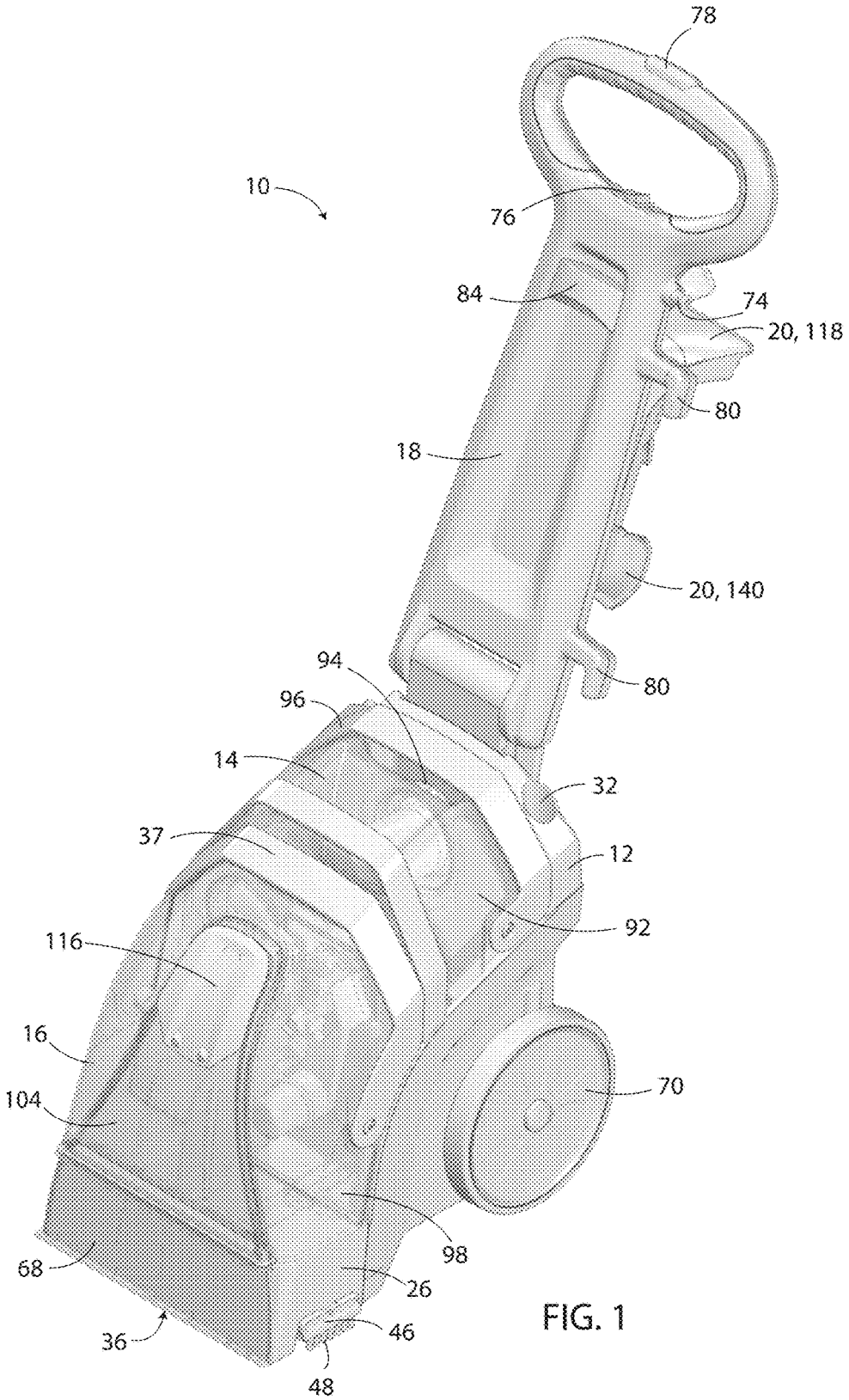
FIG. 1 is a perspective view of a preferred embodiment of a liquid extraction cleaning device in accordance with the invention and shows the front, top, and right sides thereof.
Figure 2:
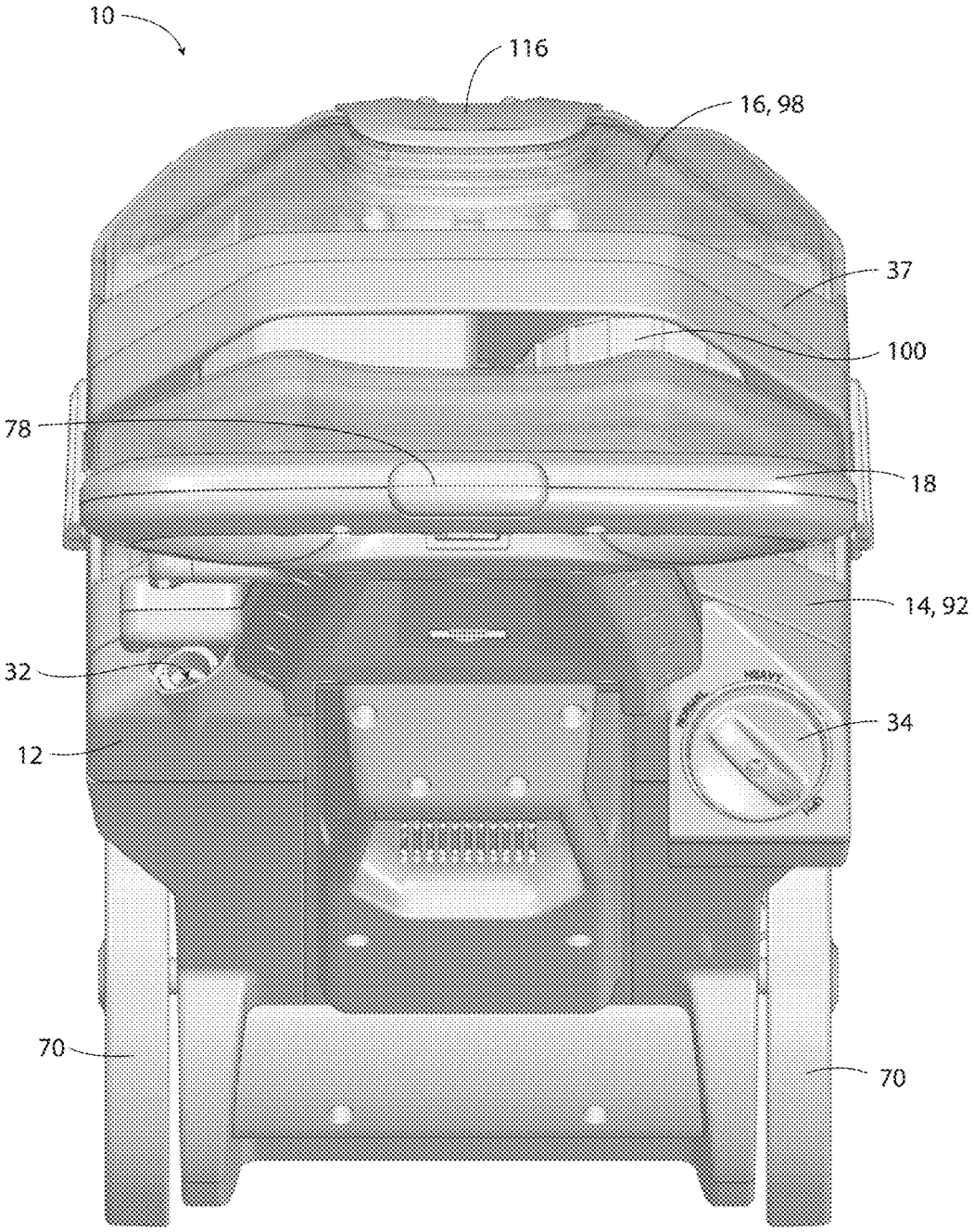
FIG. 2 is a perspective view of the extraction cleaning device and shows the rear and top thereof.

Reference numerals in the written specification and in the drawing figures indicate corresponding items.

DETAILED DESCRIPTION

A preferred embodiment of a liquid extraction cleaning device in accordance with the invention is shown in FIGS. 1-4. The extraction cleaner 10 comprises a main unit 12, a cleaning solution tank assembly 14, a recovery tank assembly 16, a handle 18, and accessories 20.

The main unit 12 comprises a vacuum pump 22, a liquid pump 24, an agitator assembly 26, a primary spray nozzle 28, and preferably a secondary spray nozzle 30, an accessory tool liquid port 32, a spray selection switch 34, and a vacuum inlet port 36, and a lifting handle 37.

The vacuum pump 22 is operatively connected to the recovery tank assembly 16 in a manner such that the vacuum pump can draw air from the recovery tank. The recovery tank assembly 16 is operatively connected to the vacuum inlet port 36 in a manner such that the vacuum inlet port draws in air and/or liquid when air is drawn from the recovery tank assembly by the vacuum pump 22. The liquid pump 24 is operatively connected to the solution tank assembly 14 for drawing liquid therefrom, and is operatively connected to the primary spray nozzle 28, the secondary spray nozzle 30, and the accessory tool liquid port 32 to supply pressurized liquid thereto. The spray selection switch 34 is operatively connected to the liquid pump 24 and preferably is a hand operated mechanical fluid valve that has three settings for channeling the liquid from the liquid pump. In one setting, the spray selection switch 34 allows liquid to travel from the liquid pump 24 to the primary spray nozzle 28, while preventing liquid from traveling from the liquid pump to the secondary spray nozzle 30 and/or accessory tool liquid port 32. In another setting, the spray selection switch 34 allows liquid to travel from the liquid pump 24 to the primary spray nozzle 28 and the secondary spray nozzle 30, while preventing liquid from traveling from the liquid pump to the accessory tool liquid port 32. In the third setting, the spray selection switch 34 allows liquid to travel from the liquid pump 24 to the accessory tool liquid port 32, while preventing liquid from traveling from the liquid pump to the primary spray nozzle 28 and/or the secondary spray nozzle 30. It should be appreciated however that this functionality could alternatively be carried out via electrical valves or a combination of electrical and mechanical valves.

Figure 8:
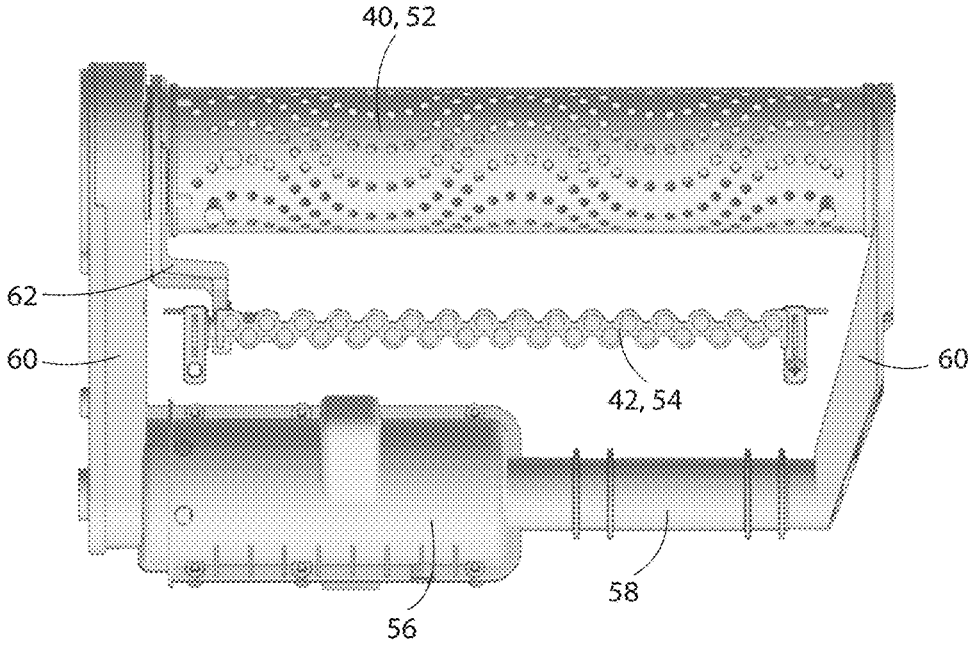
FIG. 8 is a bottom view of the portions of the agitator assembly of the extraction cleaning device.
Figure 9:
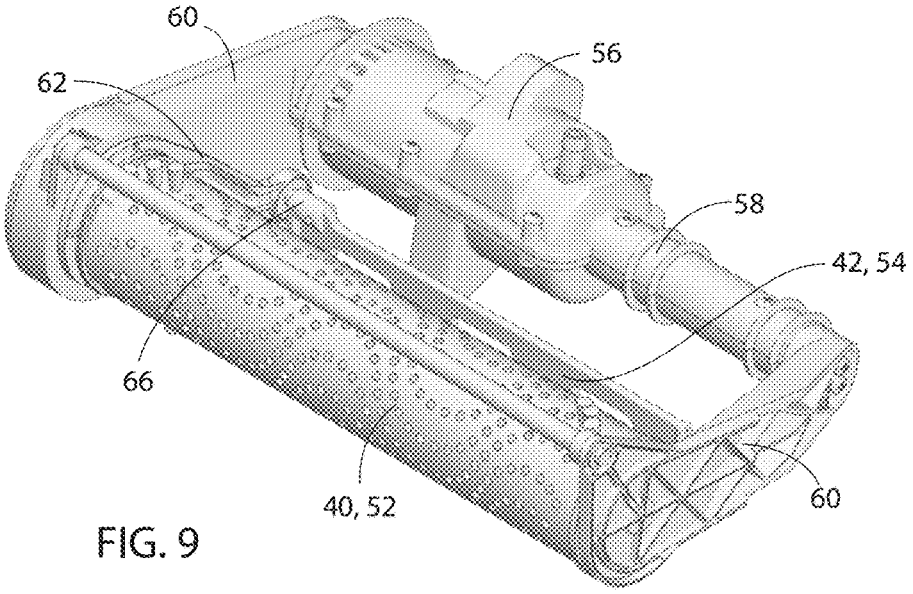
FIG. 9 is a perspective view of said portions of the agitator assembly, showing the front, top, and right sides thereof.
Figure 10:
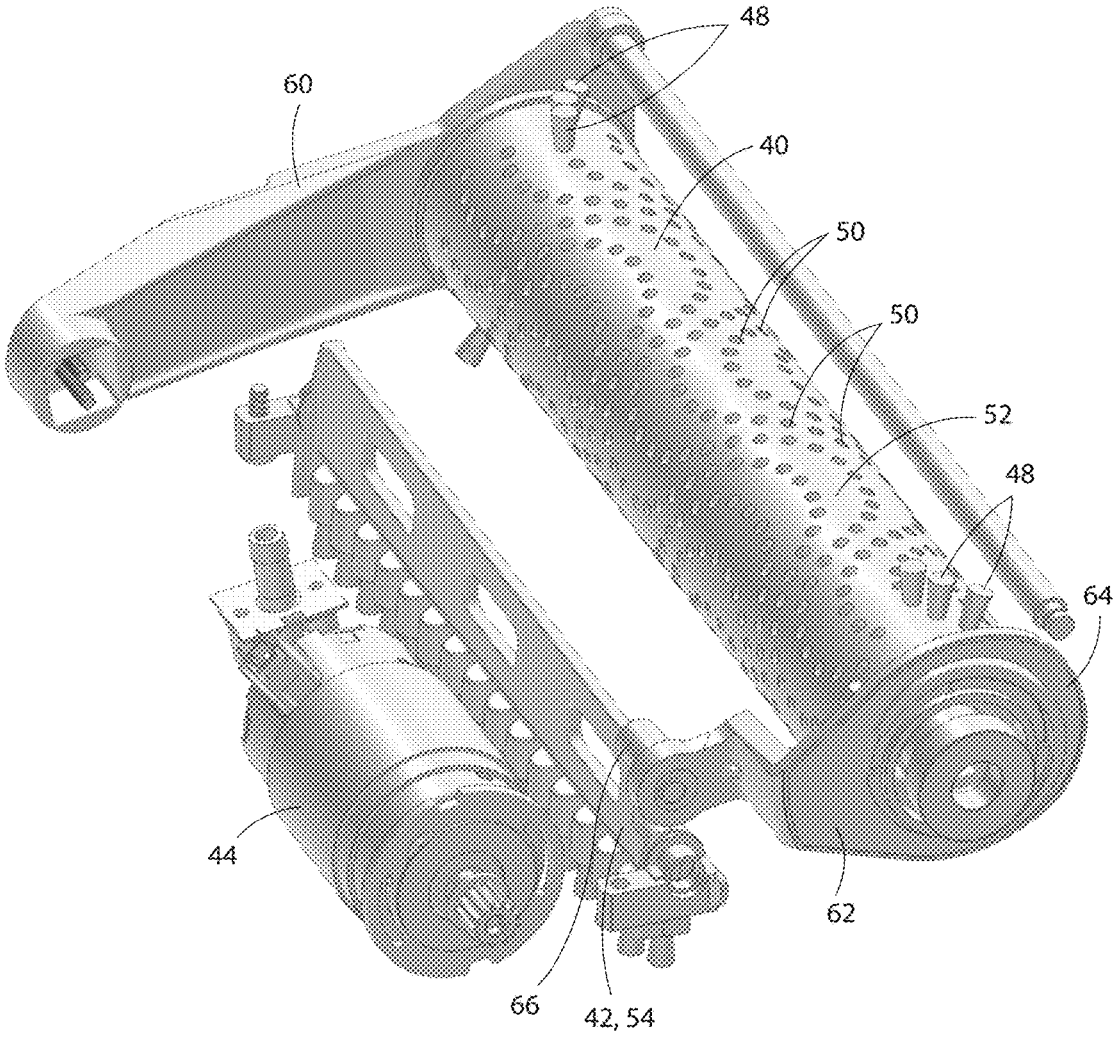
FIG. 10 is a perspective view of the agitator assembly with additional components omitted to show detail thereof.

The agitator assembly 26 of the main unit 12 comprises a housing 38, a rotational agitator 40, a reciprocating agitator 42, an electric motor 44, and a pair of fixed side brushes 46. The rotational agitator 40 comprises a plurality of bristles 48 (some of which are omitted in the drawing figures) that extend from bristle holes 50 formed in a roller 52. The reciprocating agitator 42 is preferably configured to pivotally reciprocate and comprises brush bar 54 (also comprising bristles 48) that pivotally reciprocates about an axis that is parallel to the rotational axis of the rotational agitator 40. The axis about which the reciprocating agitator 42 pivots is preferably fixed relative to the housing 38. In contrast, the axis about which the rotational agitator 40 revolves preferably is able to pivot up or down (parallel to the ground) about an axis defined by the motor housing 56 that surrounds the electric motor 44. As shown most clearly in FIGS. 8 and 9, the motor housing 56 comprises an axle portion 58 that is free to pivot within a channel formed partially by the housing 38 and partially by the adjacent portion of the bottom of the main unit 12 of the liquid extraction cleaning device 10. Rigid arms 60 fixed to the motor housing 56 extend from the motor housing and connect to the opposite ends of the rotational agitator 40. Thus, motor housing 56 and the rotational agitator 40 pivot together about the axis of the axle portion 58 of the motor housing relative to the housing 38 of the agitator assembly 26. As such, only the force of gravity acting on the motor housing 56 and the rotational agitator 40 forces the rotational agitator downward against a floor (the weight of the electric motor 44 does not influence that force since the center of mass of the motor is aligned with the axle portion 58 of the motor housing). The electric motor 44 preferably drives the rotation of the rotational agitator 40 via a drive belt (not shown) located in one of the arms 60. A linking member 62 preferably connects an off-axis portion 64 adjacent to an end of the rotational agitator 40 to a pivot arm 66 of the reciprocating agitator 42. The linking member 62 thereby transforms rotational movement of the rotational agitator 40 into pivotal reciprocation of the reciprocating agitator 42. The fixed side brushes 46 of the agitator assembly 26 are mounted to the bottom of the housing 38 on opposite sides of the rotational agitator 40. Thus, the fixed side brushes 46 move only with the main unit 12 of the liquid extractor 10. The front of the housing 38 of the agitator assembly 26 also forms a part of the vacuum inlet port 36, with the other portion being formed by a piece of translucent material 68 in a manner such that liquid drawn into the vacuum inlet port can easily be observed. The housing 38 also supports the primary spray nozzle 28.

As shown below in FIG. 3, the vacuum inlet port 36 is preferably located adjacent the front on the bottom of the main unit 12 and the rotational agitator 40 lies behind the vacuum inlet port 36 and between the vacuum inlet port and the reciprocating agitator 42. The primary spray nozzle 28 is preferably located immediately aft of the reciprocating agitator 42 and is configured to spray liquid downward in a fan-like pattern. In contrast, the secondary spray nozzle 30 is positioned on the rear of the liquid extraction cleaning device 10 and is preferably at least three times as far behind the vacuum inlet port as compared to the primary spray nozzle 28. It should be appreciate that, in operation, liquid extraction cleaning device 10 is preferably pulled rather than pushed. Thus, carpet is first wetted by the primary spray nozzle 28 or by the primary and secondary spray nozzles 28, 30 prior to being agitated, and liquid extraction via the vacuum inlet port 36 occurs after agitation. By positioning the secondary spray nozzle 30 much further behind the vacuum inlet 36 port as compared to the primary spray nozzle 28, the liquid sprayed from the secondary spray nozzle has a much longer dwell time on/in the carpet than does the liquid sprayed from the primary spray nozzle. Thus, operation of the secondary spray nozzle 30 not only increases the amount of liquid per area sprayed during a given pass of the liquid extraction cleaning device 10, but also increases the penetration time in which the liquid can penetrate the carpet. It should therefore be appreciated that the secondary spray nozzle 30 is typically only used during an initial cleaning pass or when deep liquid penetration is desired. The lifting handle 37 is preferably positioned above the center of gravity of the liquid extraction cleaning device 10 and is configured to support the weight of the entire liquid extraction cleaning device.

A pair of wheels 70 are preferably attached to the main unit 12 on opposite sides thereof and adjacent the rear of the liquid extraction cleaning device 10. The wheels 70 not only make it easier to pull the liquid extraction cleaning device 10 over carpet during operation, but also allow users to tilt the main unit 12 about the wheels and thereby push the liquid extraction cleaning device.

Figure 4:
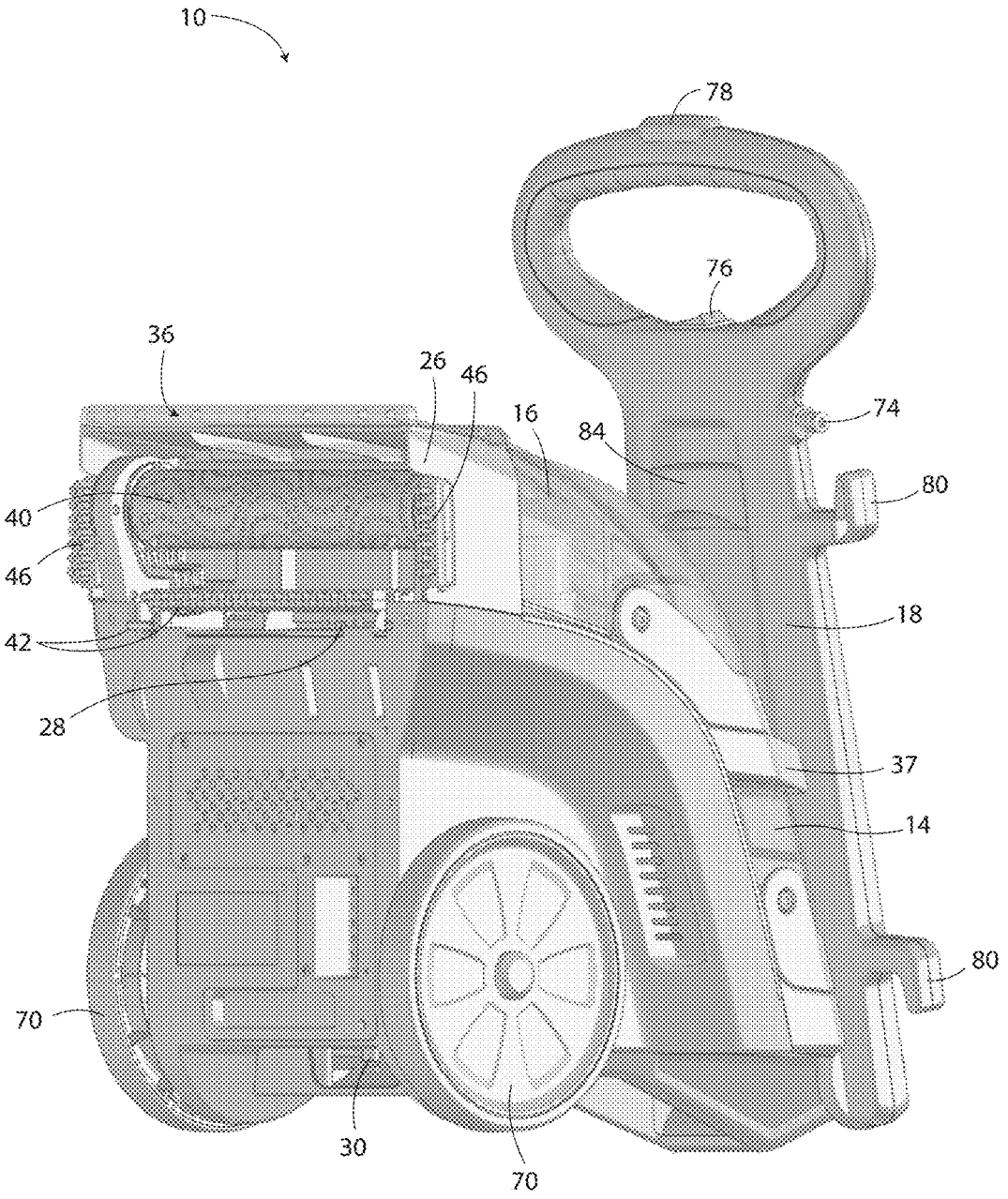
FIG. 4 is a perspective view of the extraction cleaning device in a stowed configuration.
Figure 5:
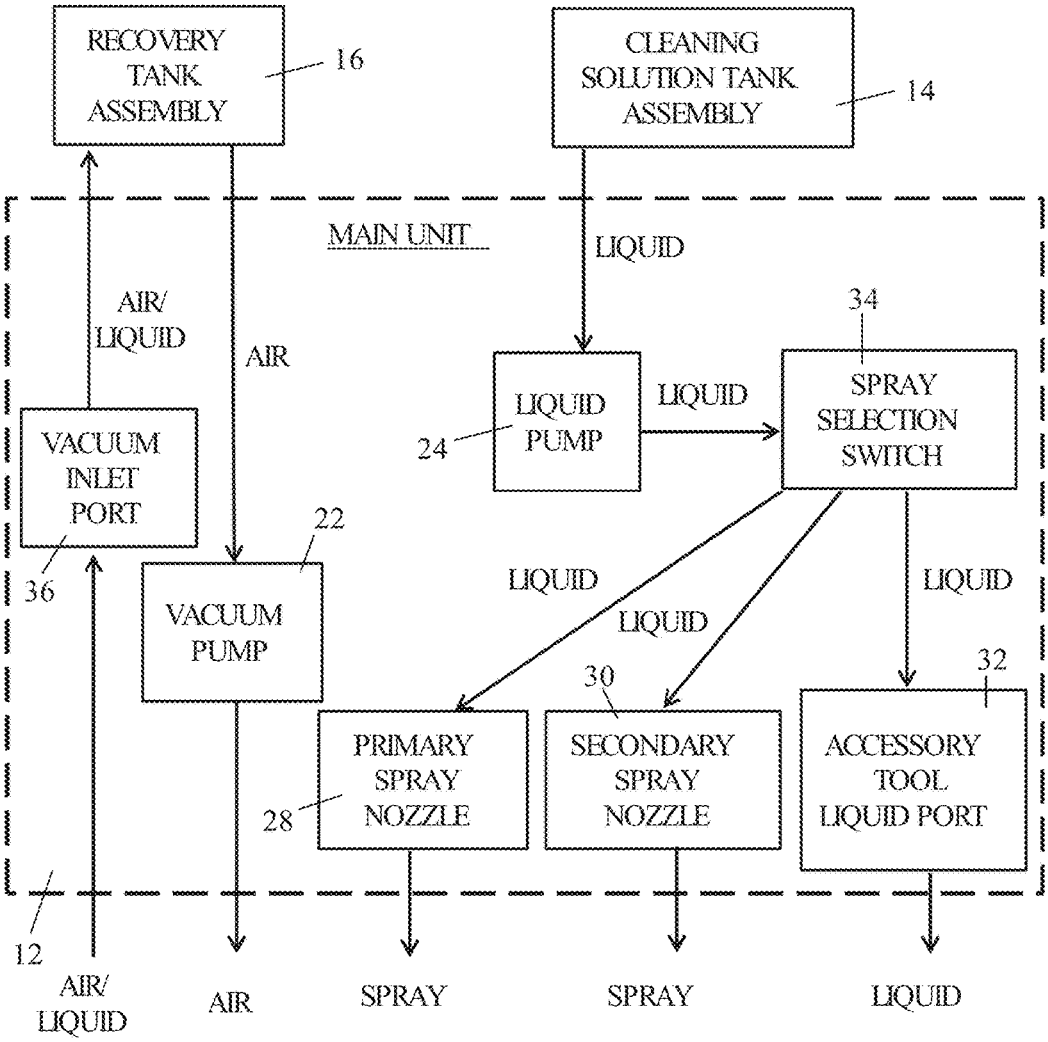
FIG. 5 is a schematic of the main unit and tank assemblies of the extraction cleaning device.
Figure 6:
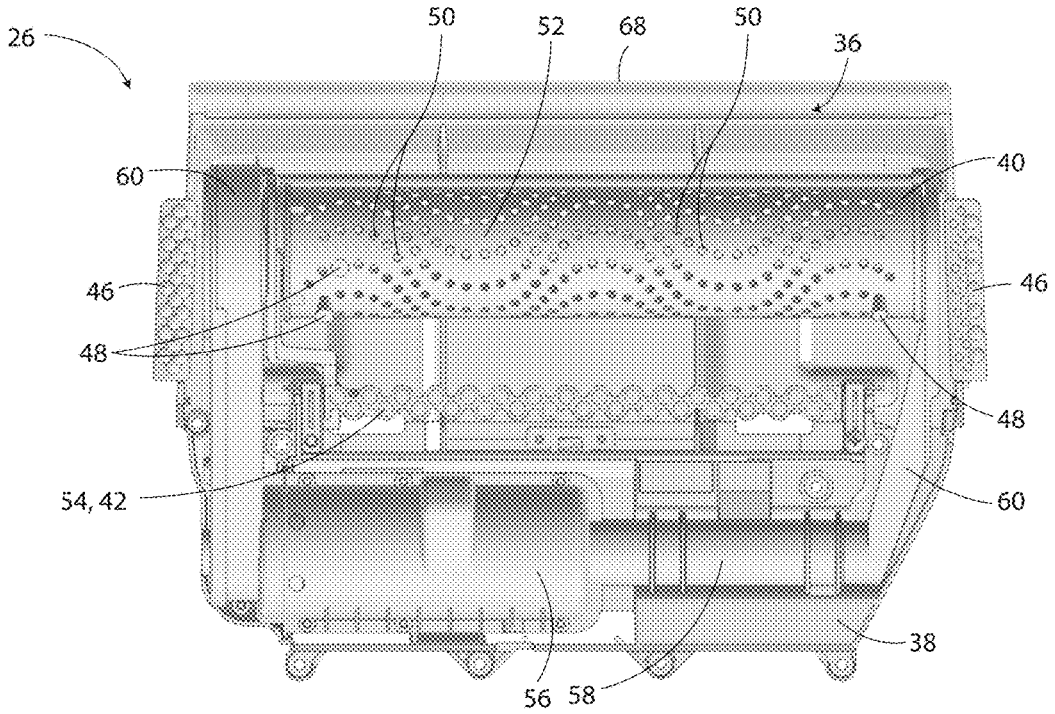
FIG. 6 is a bottom view of the agitator assembly of the extraction cleaning device.
Figure 7:
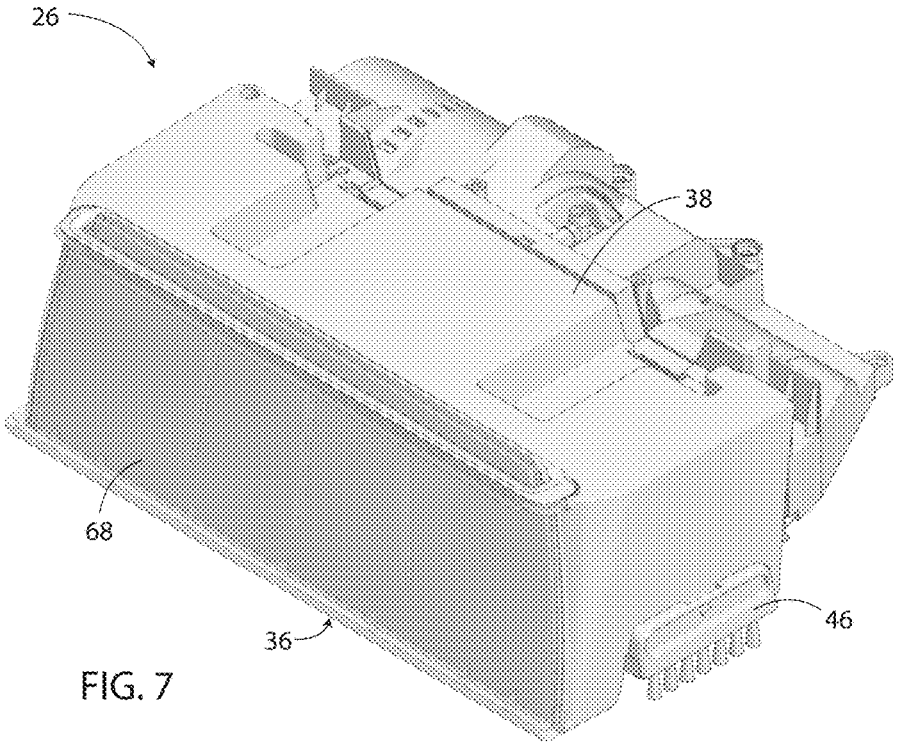
FIG. 7 is a perspective view of the agitator assembly of the extraction cleaning device, showing the front, top, and right sides thereof.
Figure 11:
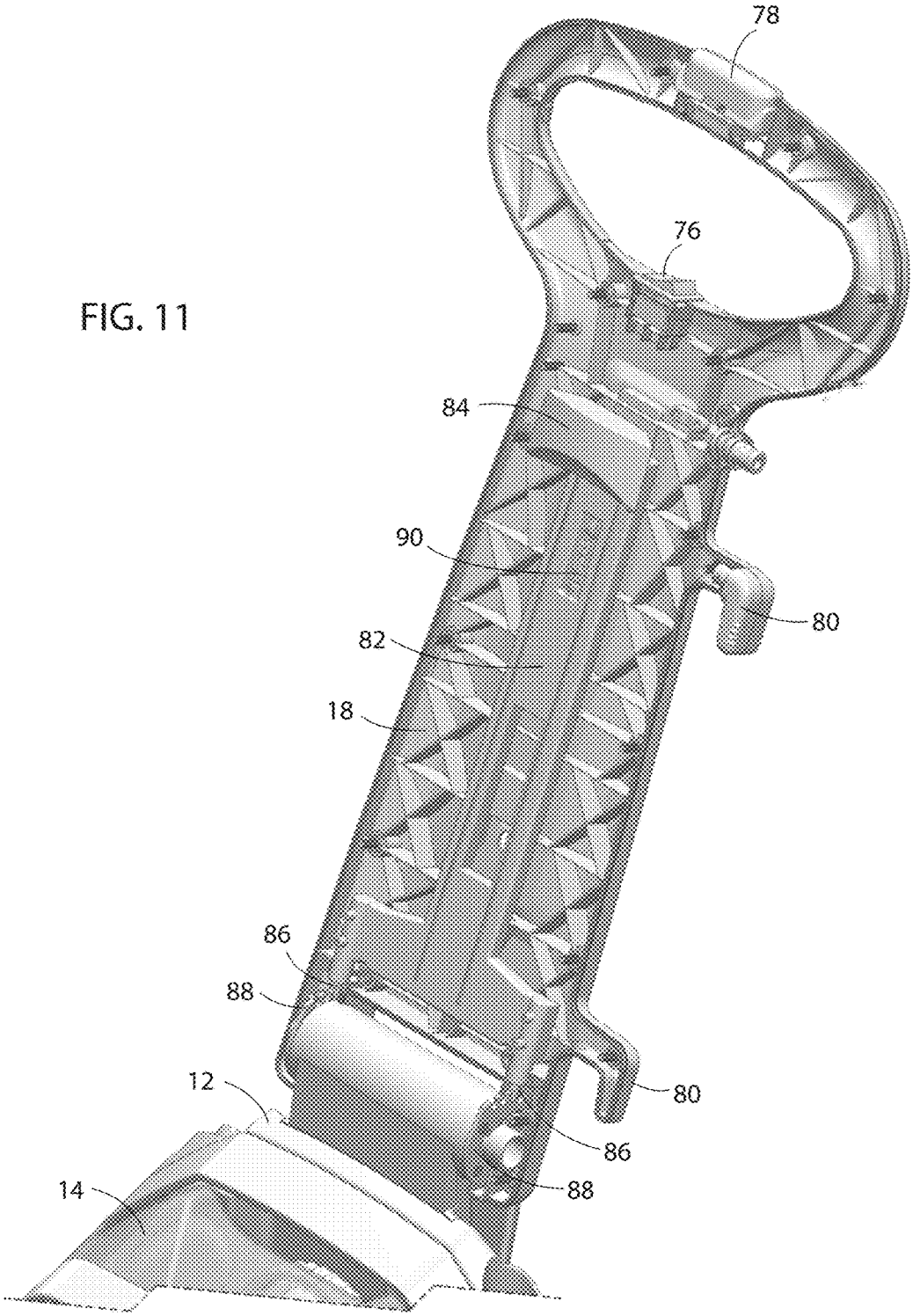
FIG. 11 is a perspective view showing of the handle with the front half of the handle removed to show the locking mechanism of the handle.
Figure 12:
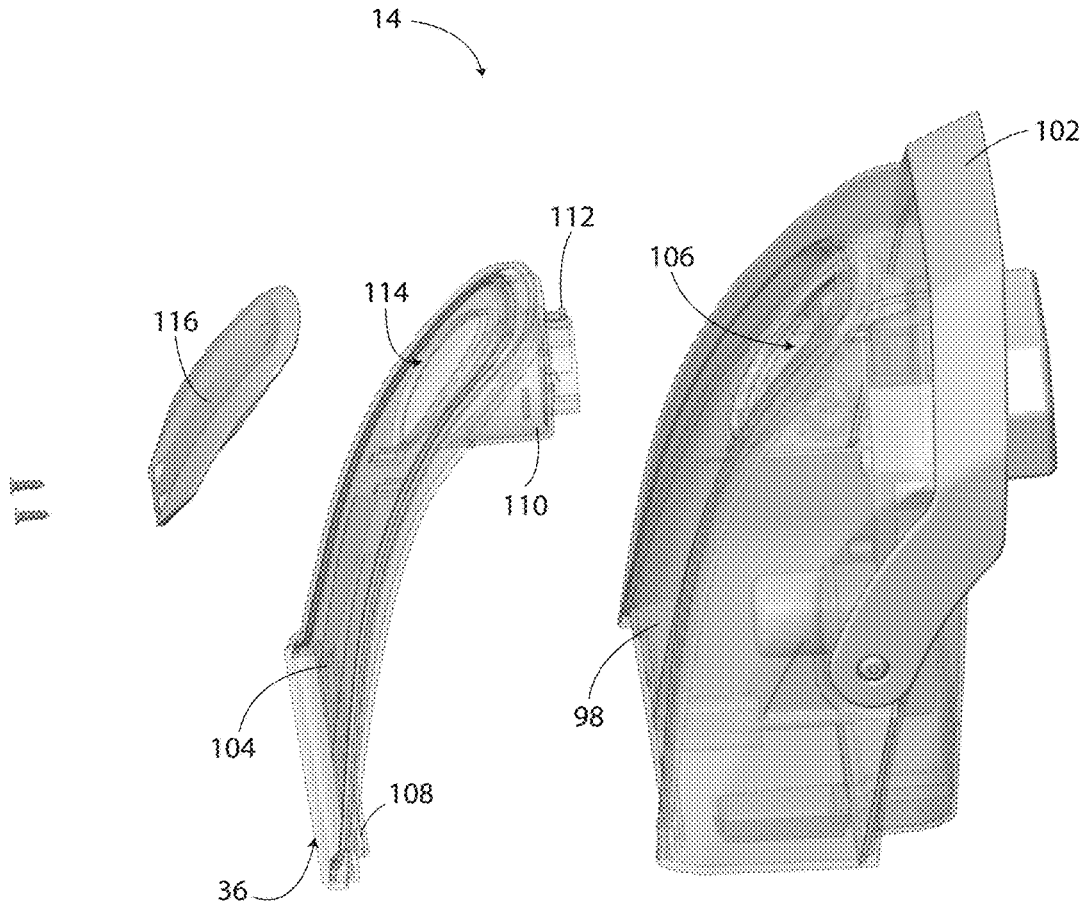
FIG. 12 is a perspective view of the recovery tank assembly of the extraction cleaning device.

The handle 18 of the liquid extraction cleaning device 10 is preferably pivotally connected to the upper rear edge of the main unit 12. The handle preferably comprises a locking mechanism 72, an electrical input port 74, a main power switch 76, a liquid pump switch 78, and power cord wrap posts 80. As shown in FIG. 11, the locking mechanism preferably comprises an internal linking member 82 connecting an external release member 84 to internal locking pins 86. The locking pins 86 cooperate with notched members 88 that are fixed relative to the main unit 12 of the liquid extraction cleaning device 10 in a manner such that the locking mechanism 72 can fix the pivotal orientation of the handle 18 relative to the main unit in any of a plurality of angles. The linking member 82 is preferably biased toward the notched members 88 via a spring 90 such that the locking mechanism 72 only allows the handle 18 to pivot relative to the main unit 12 when the release member 84 is pulled away from the base of the handle. Preferably, the handle 18 can be pivoted forward relative to the main unit 12 to such a degree that the handle is horizontal or even tilts downward a bit. As shown in FIG. 4, with the handle 18 tilted forward, the entire liquid extraction cleaning device 10 can be tilted on its back such that minimal floor space is required to stow the liquid extraction cleaning device. The electrical input port 74 on the handle 18 merely is a port for receiving the power supply cord (not shown) of the liquid extraction cleaning device 10 and the power cord wrap posts 80 are merely conventional posts for wrapping and storing the power cord when the extraction cleaning device is not in use. The main power switch 76 of the handle 18 is preferably an electrical three-way toggle switch that is capable of shutting off all power to the liquid extraction cleaning device 10. Alternatively, the main power switch 76 can be toggled to activate the vacuum pump 22 or the vacuum pump and, simultaneously, the electric motor 44 of agitator assembly 26. In either of such later alternatives, the liquid pump 24 can also be activated by depressing the liquid pump switch 78 of the handle 18.

The cleaning solution tank assembly 14 comprises a tank portion 92, a fill cap 94, and a handle 96. Like with typical liquid extraction cleaning devices, the tank portion 92 is operatively connected to the liquid pump 24 when the tank portion is in position on the main unit 12. To refill the cleaning solution tank assembly 14 with cleaning solution (which should be understood to include water by itself too), a person can lift up on the handle 96. The handle 96 is preferably pivotally connected to the tank portion 92 such that the handle pivots upward when relative to the tank portion when lifted. This makes it easier to hold and lift the entire cleaning solution tank assembly 14 from the main unit 12. The fill cap 94 is preferably threadably attached to the tank portion 92 and is threadably removed to refill the tank. The fill cap 94 also preferably serves as a measuring cup for diluting concentrated cleaning solution.

The recovery tank assembly 16 comprises a tank portion 98, a drain cap 100, a handle 102, and an intake duct 104. Like typical recovery tanks, the tank portion 98 is configured to collect liquid extracted through the vacuum inlet port 36 of the main unit 12 as air is drawn out of the tank portion 98 via the vacuum pump 22. The front wall of the tank portion 98 comprises the opening 106 through which an air and liquid mixture enters the tank. The drain cap 100 is preferably threadably attached to a drain port of the tank portion 98 and can be threadably removed therefrom to drain the tank. The intake duct 104 surrounds an intake passageway. The intake duct 104 comprises a lower catch 108 and an upper discharge tube 110. The discharge tube 110 surrounds a portion of the intake passageway and comprises a releasable locking tab 112 that cooperates with the lower catch 108 to releasably attach the intake duct 104 to the tank portion 98 of the recovery tank assembly 16. More specifically, the intake duct 104 is attached to the tank portion 98 by first hooking the lower catch 108 over a lip at the bottom of the front wall of the tank portion 98, and thereafter pivoting the intake duct upward about the lower catch such that the discharge tube 110 extends through the opening 106 of the tank portion 98 and the locking tab 112 clicks. Once the locking tab 112 clicks, the locking tab prevents the intake duct 104 from separating from the tank portion 98 unless the locking tab is manually deflected by reaching into the tank from the drain port of the tank portion 98. The front wall of the intake duct 104 preferably comprises an accessory tool vacuum inlet port 114 that is selectively covered by a pliable flap 116. When the flap 116 is bent down, the accessory tool vacuum inlet port 114 is configured to receive the downstream end of an accessory tool hose as described below. When the flap 116 is up and is covering the accessory tool vacuum inlet port 114, the intake duct 104 operatively connects the vacuum inlet port 36 to the interior of the tank portion 98 of the recovery tank assembly 16. Like with the cleaning solution tank assembly 14, the handle 102 of the recovery tank assembly 16 is pivotally connected to the tank portion 98 of the recovery tank assembly to make it easier to hold and lift the entire recovery tank assembly 16 off of the main unit 12.

Figure 13:
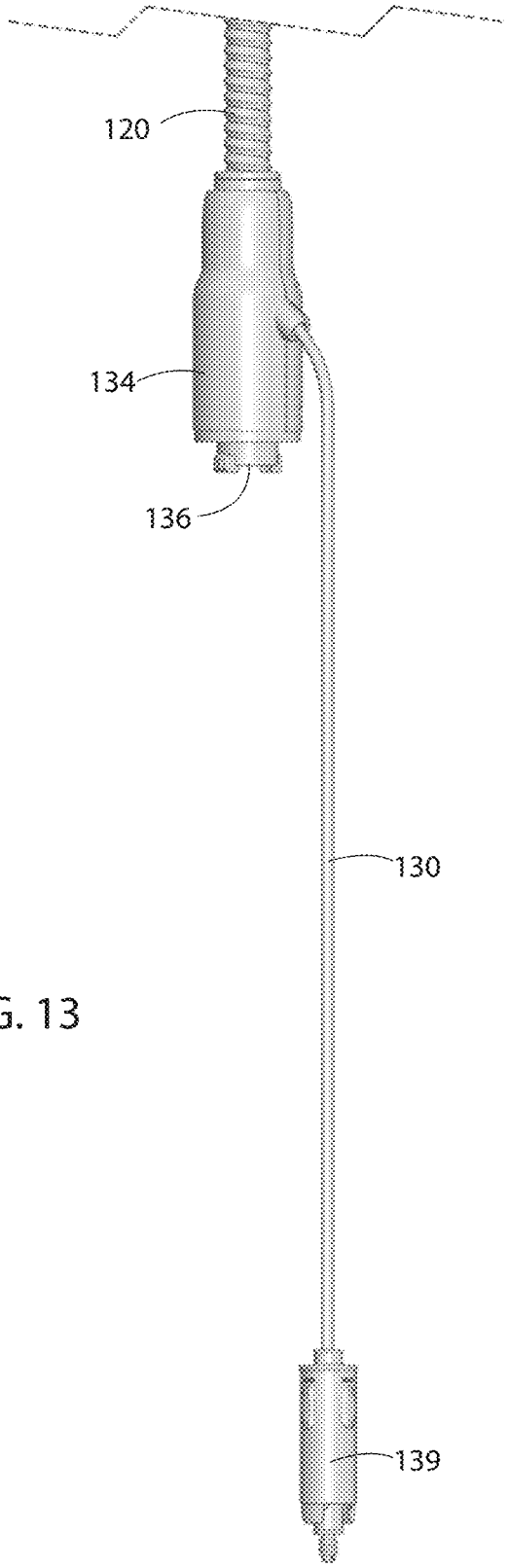
FIG. 13 is a partial view of the accessory tool hose of the extraction cleaning device and shows the downstream end thereof.
Figure 14:
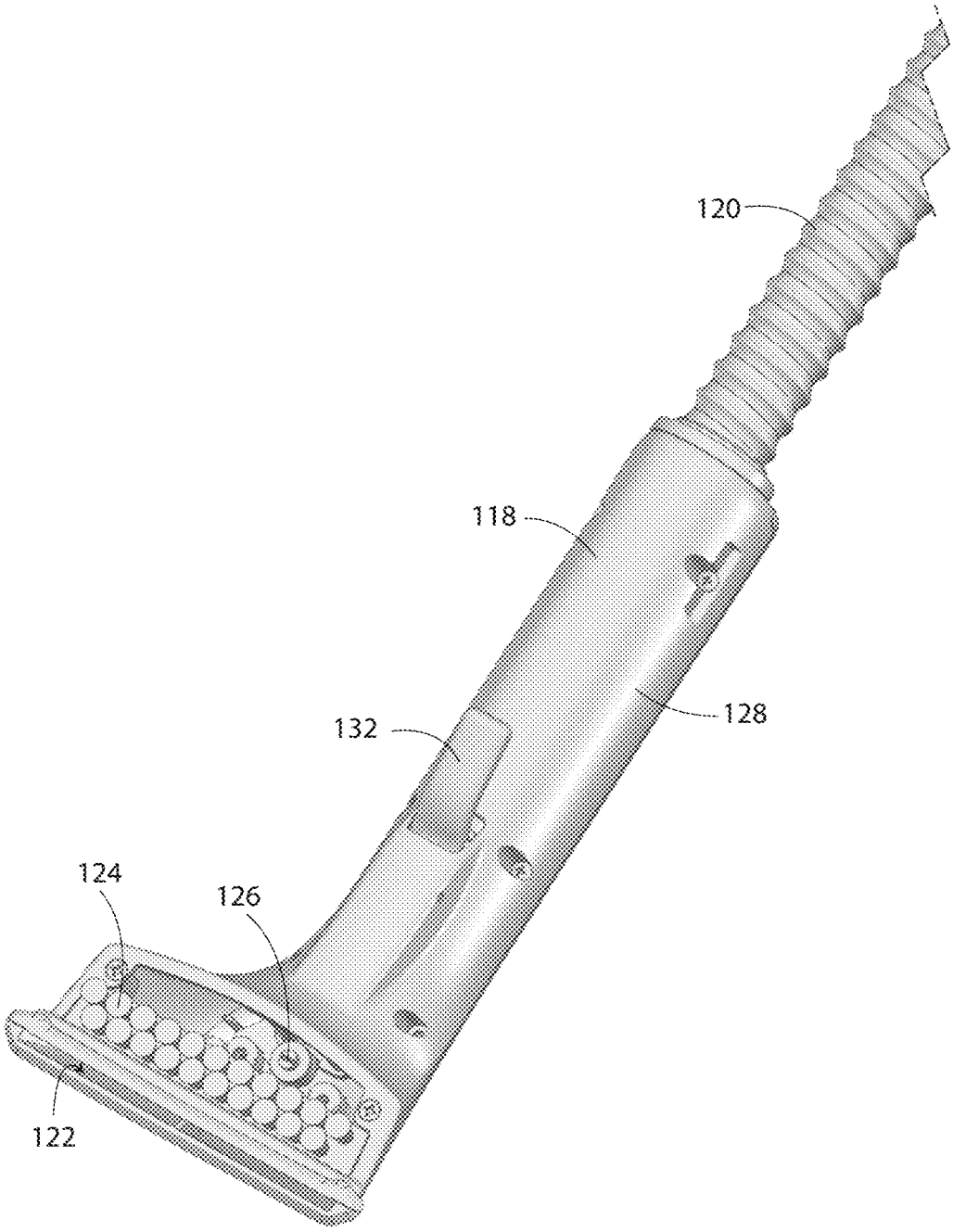
FIG. 14 is a perspective view of a hand tool accessory and a portion of the accessory tool hose.

As shown in FIGS. 13 and 14, one of the accessories 20 is a hand tool 118 that is attached to a flexible hose 120. The hand tool 118 comprises a vacuum inlet port 122, an agitator 124, and spray nozzle 126, and a grip portion 128. The vacuum inlet port 122 and the grip portion 128 are configured such that air and liquid can be drawn in through the inlet port, pass through the grip portion, and then into the hose 120. The agitator 124 is preferably a brush bar comprising bristles and is adjacent to the vacuum inlet port 122 and is preferably fixed relative to the grip portion. The spray nozzle 126 is adjacent to the agitator 124 opposite the vacuum inlet port 122 and is operatively connectable to the 24 liquid pump of the main unit 12 via flexible liquid tube 130. The grip portion 128 preferably comprises a spray trigger 132 the operates a liquid valve (not shown) in a manner such that the liquid pump 24 can only force liquid out of the spray nozzle 126 when the spray trigger is depressed.

The downstream end of the hose 120 comprises a fitting 134. The liquid tube 130 passes through the fitting wall upstream of the fitting outlet 136. The outlet 136 of the fitting 134 preferably comprises a bayonet style connector 138 and is configured to be inserted through the accessory tool vacuum inlet port 114 of the intake duct 104 of the recovery tank assembly 16. When inserted, the connector 138 of the fitting 134 can be releasably attached to the discharge tube 110 of the intake duct 104 in a manner such that the hose 120 is operatively connected to the vacuum pump 22 of the main unit 12 and such that air cannot be drawn in from the remainder of the intake duct 104 from the vacuum inlet port 36 of the main unit 12 into the tank portion 98 of the recovery tank assembly 16. The end of the liquid tube 130 comprises a fitting 139 that is connectable to the accessory tool liquid port 32 of the main unit 12 for operatively connecting the spray nozzle 126 of the hand tool 118 to the liquid pump 24 of the main unit.

Figure 3:
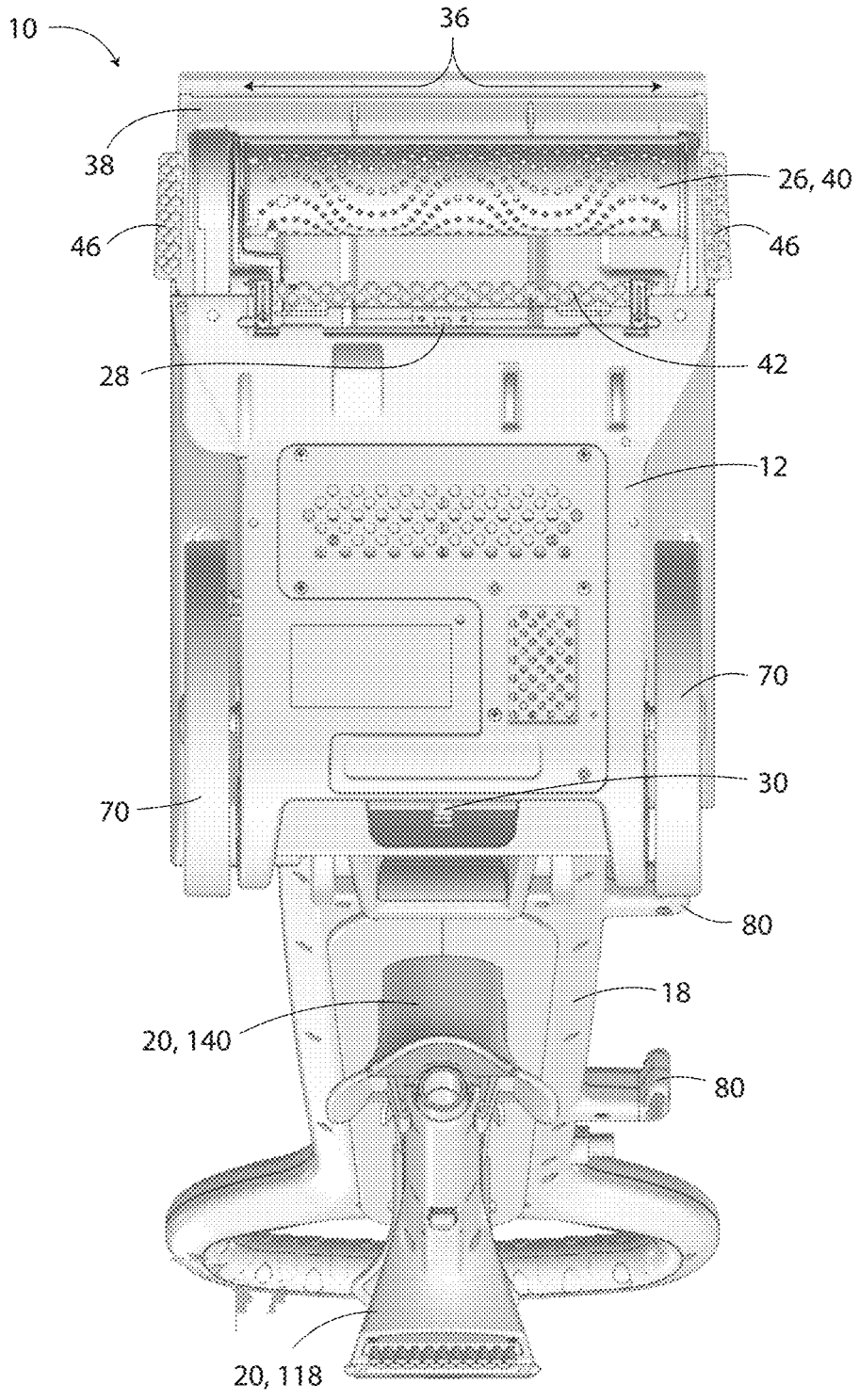
FIG. 3 is a bottom view of the extraction cleaning device.

As shown in FIGS. 1 and 3, another one of the accessories 20 of the liquid extraction cleaning device is a tool caddy 140 that is removably connectable to the rear side of the handle 18. The tool caddy is configured to releasably hold the hand tool 118 and the hose 120 when the hand tool 118 is not in use.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. A liquid extraction cleaning device comprising:

a vacuum pump;

a liquid pump;

a cleaning solution tank, the cleaning solution tank being configured and adapted to store a cleaning liquid, the cleaning solution tank being operatively connected to the liquid pump in a manner such that the liquid pump can draw cleaning liquid from the cleaning solution tank;

a recovery tank, the recovery tank being configured and adapted to store soiled cleaning liquid extracted from a floor, the recovery tank being operatively connected to the vacuum pump in a manner such that the vacuum pump can draw air from the recovery tank;

a spray nozzle, the spray nozzle being operatively connected to the liquid pump in a manner such that the liquid pump is capable of forcing cleaning liquid out of the spray nozzle;

a vacuum inlet port, the vacuum inlet port being operatively connected to the recovery tank and the vacuum pump in a manner such that the vacuum pump is capable of drawing fluid through the vacuum inlet port and into the recovery tank; and an agitator assembly, the agitator assembly comprising first and second agitators and an electric motor, the first agitator being operatively connected to the electric motor in a manner such that operation of the electric motor causes the first agitator to rotate relative to the vacuum inlet port, the second agitator being operatively connected to the electric motor in a manner such that operation of the electric motor causes the second agitator to reciprocate relative to the vacuum inlet port.

2. A liquid extraction cleaning device in accordance with claim 1 wherein the second agitator is operatively connected to the electric motor via the first agitator in a manner such that rotation of the first agitator mechanically drives reciprocation of the second agitator.

3. A liquid extraction cleaning device in accordance with claim 1 wherein the first and second agitators are located between the vacuum inlet port and the spray nozzle.

4. A liquid extraction cleaning device in accordance with claim 1 wherein the second agitator is operatively connected to the electric motor in a manner such that operation of the electric motor causes the second agitator to pivotally reciprocate about a reciprocation axis.

5. A liquid extraction cleaning device in accordance with claim 1 wherein the first agitator is movable vertically relative to the vacuum inlet port.

6. A liquid extraction cleaning device in accordance with claim 5 wherein the second agitator is operatively connected to the electric motor in a manner such that operation of the electric motor causes the second agitator to pivotally reciprocate about a reciprocation axis, and the reciprocation axis is fixed in position relative to the vacuum inlet port.

7. A liquid extraction cleaning device in accordance with claim 6 wherein the first agitator is confined to move along an arc path when the first agitator moves vertically relative to the vacuum inlet port.

* * * * *